US008191644B2

(12) United States Patent
Rytlewski et al.

(10) Patent No.: US 8,191,644 B2
(45) Date of Patent: Jun. 5, 2012

(54) TEMPERATURE-ACTIVATED SWELLABLE WELLBORE COMPLETION DEVICE AND METHOD

(75) Inventors: Gary Rytlewski, League City, TX (US); Nitin Vaidya, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 268 days.

(21) Appl. No.: 12/632,493

(22) Filed: Dec. 7, 2009

(65) Prior Publication Data

US 2011/0132611 A1 Jun. 9, 2011

(51) Int. Cl.
*E21B 33/12* (2006.01)
*E21B 23/00* (2006.01)
*E21B 33/13* (2006.01)

(52) U.S. Cl. ..... 166/387; 166/179; 166/118

(58) Field of Classification Search ..... 166/387; 175/230; 277/934

See application file for complete search history.

(56) References Cited

U.S. PATENT DOCUMENTS 1,355,802 A * 10/1920 Williams ..... 277/441
3,918,523 A * 11/1975 Stuber ..... 166/285
7,143,832 B2 12/2006 Freyer
7,318,481 B2 1/2008 Richard
7,373,991 B2 5/2008 Vaidya
7,392,841 B2 7/2008 Murray
7,637,320 B2 12/2009 Howard
7,665,537 B2 2/2010 Patel
7,708,073 B2 5/2010 Richard
2005/0199401 A1* 9/2005 Patel et al. ..... 166/387

* cited by examiner

*Primary Examiner* — Cathleen Hutchins
(74) *Attorney, Agent, or Firm* — Rodney V. Warfford; Tim Curington; William Ryann

(57) ABSTRACT

Disclosed herein is a completion device that includes an interior layer that swells when exposed to a wellbore fluid; and an exterior layer encasing the interior layer and configured to be impermeable to the wellbore fluid at temperatures below an activation depth temperature, and configured to be permeable to the wellbore fluid at temperatures above the activation depth temperature. Also disclosed herein is a method of deploying a completion device that includes encasing an interior layer of the device in a temperature-sensitive exterior layer that is impermeable to a fluid in the wellbore at temperatures below an activation depth temperature; attaching the device on a tube string; inserting the tube string into the wellbore; creating a leak path in the temperature-sensitive exterior layer in response to the device being exposed to the activation depth temperature in the wellbore; and swelling the interior layer with the wellbore fluid.

19 Claims, 4 Drawing Sheets

TEMPERATURE-ACTIVATED SWELLABLE WELLBORE COMPLETION DEVICE AND METHOD

BACKGROUND

In wellbore completions, various completion devices can be used to block a flow of fluid for a variety of reasons. A packer, for example, has been used to isolate a region of an annulus between the exterior of a tube string and the radial extent or side of the wellbore. A challenge in isolating regions of the annulus arises when the diameter of the wellbore departs from the expected or nominal value, for example, where a wash-out has occurred. Wash-outs can increase the wellbore interior diameter to larger than the gauge size of the drill that created the wellbore. A variety of designs have been employed to account for wash-outs, thereby allowing the packer to seal regions regardless of whether a wash-out has occurred in that region. One such design employs a swellable elastomeric material. The swellable elastomeric material can absorb wellbore fluid to engage the inside diameter of the wellbore, despite any wash-out conditions that may exist.

When using swellable materials in completion devices, such as wellbore packers, however, it is important to ensure that the swellable materials do not prematurely swell. Wellbore packers that prematurely swell can engage the wellbore before the wellbore completion is completely deployed into the well. This can cause the wellbore packer to shear, tear, or otherwise sustain damage, which can undermine the integrity of a sealing engagement between the completion device and the wellbore. Furthermore, it is not always known exactly how long deployment of the wellbore completion will take, as unforeseen delays may arise. Thus, the swellable material can be exposed to the wellbore fluid for an extended period of time, which can cause premature swelling of the completion device, even in completion devices that include swell-delaying structures, leading to destruction during subsequent insertion. Therefore, what is needed is a completion device that enables the effective use of swellable materials without premature activation.

SUMMARY

Disclosed herein is a completion device for a wellbore, comprising an interior layer that swells when exposed to a wellbore fluid; and an exterior layer encasing the interior layer and configured to be impermeable to the wellbore fluid at temperatures below an activation depth temperature, and configured to be permeable to the wellbore fluid at temperatures above the activation depth temperature.

Also disclosed herein is a method of deploying a completion device into a wellbore, comprising encasing an interior layer of the completion device in a temperature-sensitive exterior layer that is impermeable to a fluid in the wellbore at temperatures below an activation depth temperature; attaching the completion device on a tube string; inserting the tube string into the wellbore; creating a leak path in the temperature-sensitive exterior layer in response to the completion device being exposed to the activation depth temperature in the wellbore; and swelling the interior layer with the fluid in the wellbore.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
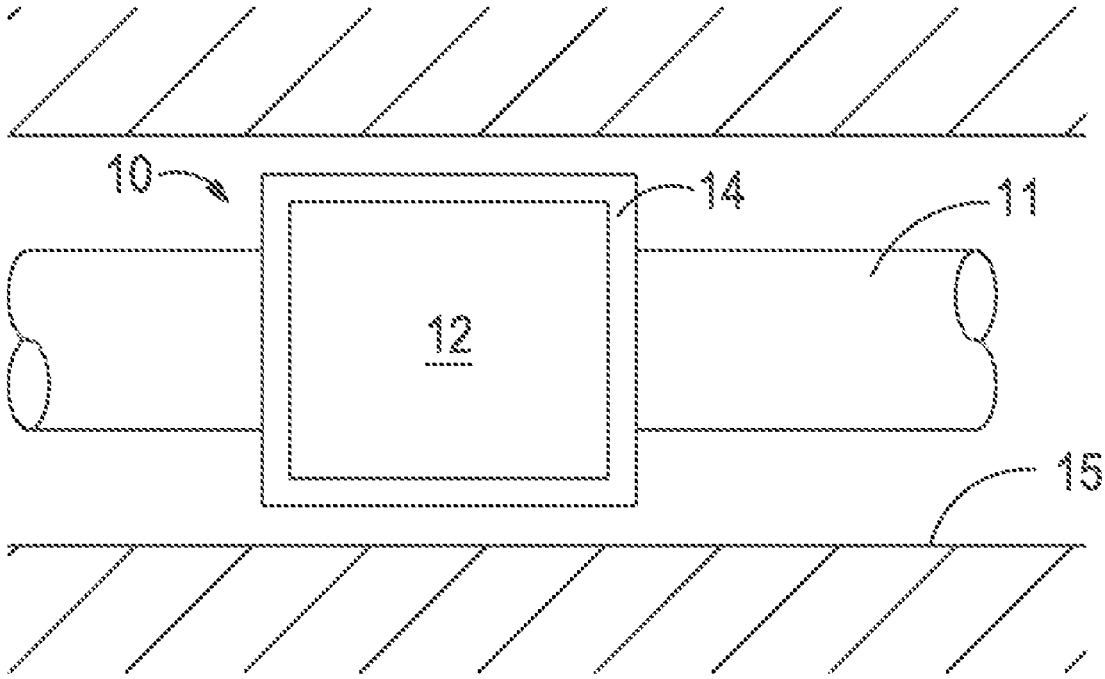
FIG. 1 depicts a simplified cross-sectional view of an exemplary completion device, in accordance with one or more embodiments described.

FIG. 1 illustrates a simplified cross-sectional view of an exemplary completion device 10. The completion device 10 can be deployed on the downhole tool (e.g., a tube string) 11 as part of a wellbore completion. The completion device 10 can include an interior layer 12 and an exterior layer 14. The interior and exterior layers 12, 14 can be any shape desired; however, in an exemplary embodiment, the interior and exterior layers 12, 14 may be annular, and may be, for example, concentric cylinders. Further, the interior and exterior layers 12, 14 may be disposed circumferentially around the tube string 11. In an exemplary embodiment, the interior and exterior layers 12, 14 can be substantially C-shaped, or can include one or more arc-shaped segments (not shown), to facilitate attachment onto the tube string 11. The completion device 10 can have a pre-activation diameter and a post-activation diameter, wherein the pre-activation diameter can be less than the nominal inside diameter of the wellbore, and the post-activation diameter can be larger than the pre-activation diameter. The post-activation diameter may not necessarily have a pre-determined value, as the completion device 10 can be designed such that the post-activation diameter is sufficiently large to sealingly engage the side of the wellbore 15, despite any departures from the nominal inside diameter of the wellbore 15.

The interior layer 12 can be configured to absorb or otherwise react with wellbore fluid and thereby expand or swell. The completion device 10 expands from its pre-activation diameter to its post-activation diameter. Accordingly, the interior layer 12 can include a swellable material, for example, a swellable elastomeric material such as that described in U.S. Pat. No. 7,143,832, which is incorporated herein by reference in its entirety, to the extent it is not inconsistent with this disclosure. It will be appreciated, however, that any wellbore friendly swellable material having a sufficient volumetric expansion potential, for example, to enable the completion device 10 to swell and seal the annulus between the downhole tool 11 and the wellbore 15, can be used in accordance with this disclosure.

The exterior layer 14 can surround the entirety of the interior layer 12, thereby encasing the interior layer 12 therein prior to activation. The exterior layer 14 can impermeably and sealingly encase the interior layer 12, such that substantially none of the wellbore fluid can diffuse or leak therethrough, thereby maintaining the interior layer 12 unexposed to the wellbore fluid prior to activation. Furthermore, the exterior layer 14 can be configured to resist chemical degradation in typical wellbore environments (i.e., not dissolve, disintegrate, or otherwise have a diminished integrity due to a chemical reaction with wellbore fluids). For example, the exterior layer 14 can be designed to remain intact in water, hydrocarbon, and/or brine, unless a predetermined temperature is reached, as described below. Furthermore, the exterior layer 14 can be configured to resist chemical degradation even in the presence of dissolved carbon dioxide, aqueous hydrogen sulfide, or other acidic or basic agents. Such agents are known to be employed as activating agents for use with chemically degradable downhole tools, such as those described in U.S. patent application Ser. No. 11/927,331, which is incorporated by reference herein in its entirety, to the extent it is not inconsistent with this disclosure. Thus, the completion device 10 can be usable in a variety of wellbore environments, without regard to wellbore fluid compositions or the addition of typical activating agents that might otherwise prematurely degrade an exterior layer 14 designed to degrade in an activation fluid. It will be appreciated, however, that the addition of other chemically degrading agents, which may not typically be seen in wellbore fluid, could potentially degrade the exterior layer 14, without departing from the scope of this disclosure.

In an exemplary embodiment, the exterior layer 14 can be made up of an alloy designed to activate at a certain temperature. More particularly, the alloy can be designed to soften or melt at a predetermined temperature, thus exposing the interior layer 12. Exemplary exterior layer 14 compositions can include bismuth, tin, indium, cadium, lead, and/or other alloyed metals. Metals can be combined in alloy to have predictable melting temperatures, which can be low relative to one or more of the constituent metals. For example, the metal alloys can have melting temperatures ranging from about 45° F. to above 450° F.

The activation or desired depth of the completion device 10, that is, the depth at which activation and/or swelling occurs, can be any depth in the wellbore 15. The temperature in a wellbore typically increases according to a known gradient, which can vary from location to location, but can be, for example, about +15° F. per 1000 ft of depth, with greater accuracy readily achieved with a geothermal survey. Accordingly, an estimate or calculation of the temperature of the wellbore fluid at the intended activation depth can be made prior to insertion, and an alloy for the exterior layer 14 can be chosen with a melting temperature of, for example, the temperature at the activation depth, less than about 5° F. higher than the temperature at the activation depth, or within about 5° F. of the temperature at the activation depth.

Since the exterior layer 14 can be impermeable, resistive to chemical degradation, and/or otherwise impervious to wellbore fluid at depths shallower than the activation depth, the interior layer 12 can be sealed from contacting the wellbore fluid, regardless of the length of time the completion device 10 remains at the shallower depths. However, once the completion device 10 reaches the activation depth, the exterior layer 14 can become soft and/or begin to melt in the presence of the temperature at the activation depth, and can then be sheared away, for example, by the wellbore fluid. This melting and shearing away of the exterior layer 14 can create leak paths through the exterior layer 14 to the interior layer 12, enabling the wellbore fluid to come into contact with the interior layer 12. Once this occurs, the interior layer 12 begins to absorb or react with the wellbore fluid and swell to the post-activation diameter, and can thereby sealingly engage the wellbore 15, despite any unexpected irregularities in the side of the wellbore 15, such as those caused by wash-outs.

In one or more embodiments, the exterior layer 14 can additionally or alternatively be made of a shape-memory alloy. The shape-memory alloy can be a Cu—Al—Ni alloy, an Fe—Mn—Si—Cr—Ni alloy, a Cu50Zr50 alloy, or a NiTi alloy, for example. Shape-memory alloys are known to deform to a predetermined shape in response to an applied temperature. The exterior layer 14 can thus be configured to activate by deforming at the local temperature at the activation depth in the wellbore 15, which can expose the interior layer 12 to the wellbore fluid. For example, the shape-memory alloy of the exterior layer 14 can be configured to activate by deforming by, for example, shrinking, warping, folding and/or rupturing, at the temperature of the wellbore at the activation depth, using techniques known in the art. This can debond or detach the exterior layer 14 from the interior layer 12, creating leak paths for the wellbore fluid to come into contact with the swellable material of the interior layer 12, thereby causing the interior layer 12 to swell.

Figure 2:
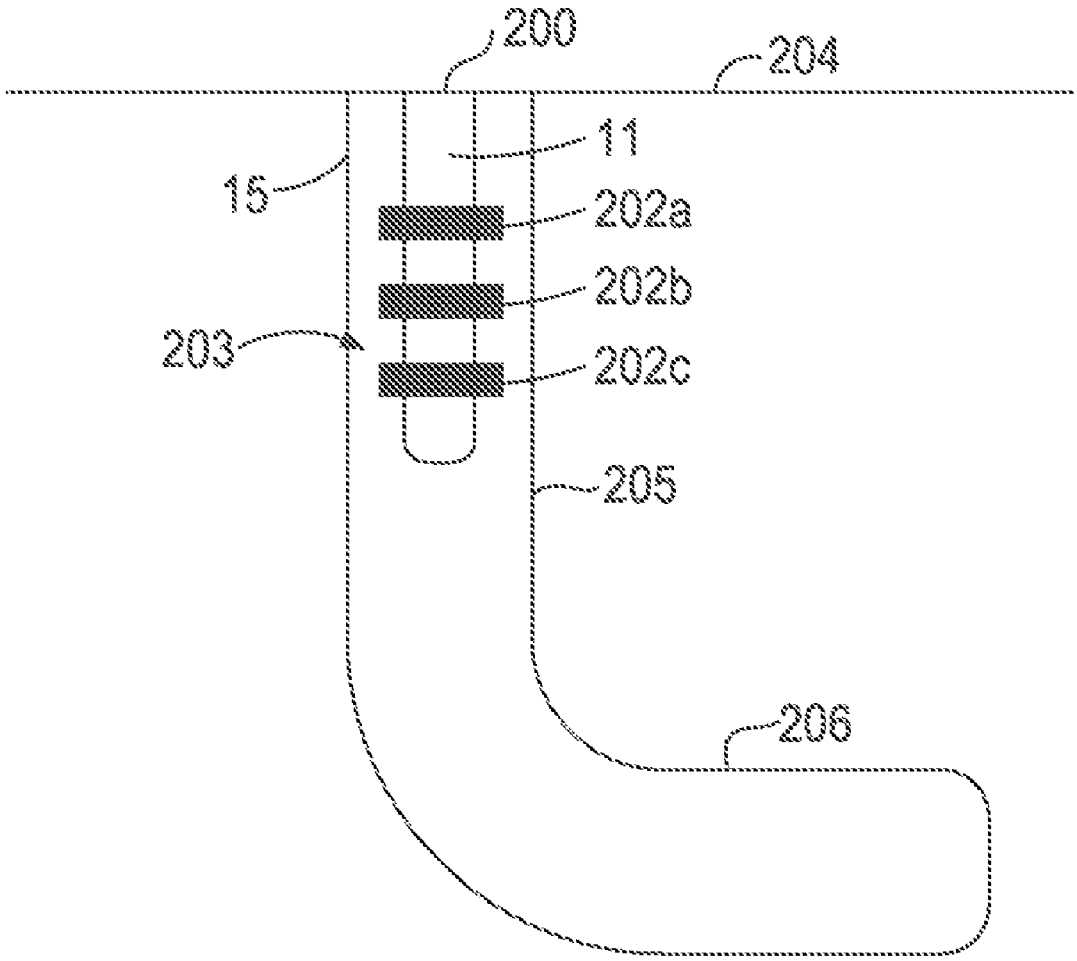
FIG. 2 depicts a simplified, partial cut-away view of a portion of an exemplary wellbore completion employing three completion devices, in accordance with one or more embodiments described.
Figure 3:
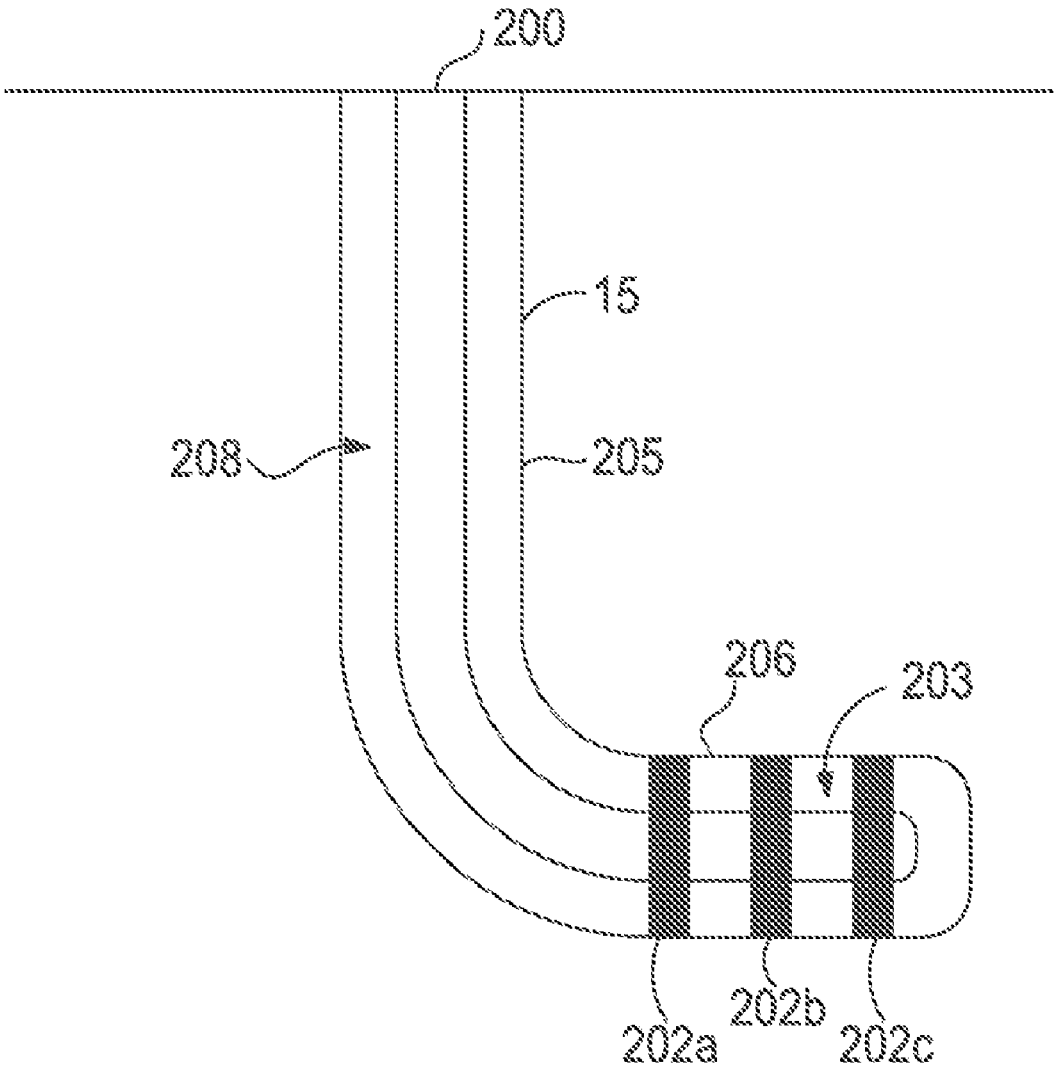
FIG. 3 depicts a simplified, partial-cut away view of the wellbore completion of FIG. 2, fully-deployed into a wellbore, in accordance with one or more embodiments described.

FIGS. 2 and 3 illustrate an exemplary insertion of a wellbore completion 200. In the illustrated exemplary embodiment, the wellbore completion 200 includes the tube string 11 and packers 202*a-c* disposed thereon, which can include embodiments of the completion device 10, as described above with reference to FIG. 1. It will be appreciated that additional or fewer packers 202 can be employed, and that some can be swellable and can conform to an embodiment of the above-described completion device 10, while some may not. Further, additional embodiments of the completion devices 10 can be employed in various other undepicted structures.

The packers 202*a-c* of the illustrated exemplary embodiment can be attached to the tube string 11 in the distal portion 203 of the wellbore completion 200. The wellbore 15 can be deviated, and can therefore include a vertical portion 205 and a horizontal portion 206. The horizontal portion 206 can be the area from which the wellbore completion 200 is designed to extract a fluid (e.g., hydrocarbons) and/or inject a fluid (e.g., steam). The distal portion 203 of the wellbore completion 200 can be designed to be deployed into the horizontal portion 206. In an exemplary embodiment, most of the elements of the wellbore completion 200 that require time-intensive assembly, such as nozzles, various subs, valves, sensors, actuators, controls, etc., can be disposed in the distal portion 203 along with the packers 202*a-c*. Indeed, in an exemplary embodiment, the proximal portion 208 (see FIG. 3) can simply include a casing designed to connect the distal portion 203 with the surface 204. Accordingly, while the distal portion 203 is being constructed, each element added on can be lowered into the wellbore 15 to a temporary shallow depth while the next element is added onto the wellbore completion 200. Once the next element is added on, it too can be lowered into the wellbore 15, thereby further deploying the wellbore completion 200 into the wellbore 15. This sequence can repeat until the wellbore completion 200 is fully-assembled and deployed. Accordingly, the distal-most packer 202*c*, which can be the first-assembled of the packers 202*a-c*, can be in the wellbore 15 for several days, weeks, or longer, before assembly of the distal portion 203 is completed, with each successive packer 202*a, b*, being subsequently added and temporarily disposed at shallow depths in the wellbore 15.

Once the distal portion 203 is completed, the proximal portion 208 can be deployed in, for example, a matter of about 6 hours to about 12 hours. Despite spending, for example, weeks in the warm, fluidic environment of the wellbore 15 while the distal portion 203 of the wellbore completion 200 is assembled, the shallow depth at which the packers 202*a-c* are temporarily disposed may not have a local temperature high enough to elevate the exterior layer 14 (see FIG. 1) of each of the packers 202*a-c* to, or sufficiently near, the temperature required to activate the exterior layer 14, thereby precluding exposure of the interior layer 12 to the wellbore fluid. Since the exterior layer 14 can also be non-reactive in the wellbore 15 environment, the integrity of the exterior layer 14 can remain unaffected indefinitely while the packers 202*a-c* remain temporarily disposed at the shallow depths. Moreover, since the exterior layer 14 can also be impermeable, the interior layer 12 of each packer 202*a-c* can remain isolated from the wellbore 15 environment indefinitely while the exterior layer 14 remains intact. Thus, the exterior layer 14 can avoid the creation of additional time-sensitive variables to the deployment of the wellbore completion 200. This allows for contingencies that can arise in the assembly of the distal portion 203 and/or the proximal portion 208 (FIG. 3), such as weather, equipment malfunctions, or other delaying events, as each packer 202*a-c* that is delayed at shallower depths can remain at its pre-activation diameter indefinitely.

FIG. 3 illustrates the wellbore completion 200 deployed down the wellbore 15 and extending to the horizontal portion 206. In various exemplary embodiments, the packers 202*a-c* and/or other embodiments of the completion devices 10 can be deployed to more than one desired depth in the vertical portion 205 of the illustrated wellbore 15, or in an undeviated vertical wellbore (not shown). In such embodiments, the exterior layer 14 of each packer 202*a-c* or other completion device 10 can be composed of different alloys, such that each alloy activates at a different temperature corresponding to the different activation depths.

With additional reference to FIG. 1, the exterior layer 14 of each of the packers 202*a-c* can begin activating once the packers 202*a-c* have reached the activation depth. For example, the exterior layer 14 of each of the packers 202*a-c* can be configured to activate (i.e., soften, melt, and/or deform) when it encounters the temperature at the activation depth, thereby exposing the interior layer 12 to the wellbore fluid. The interior layer 12 can then begin to absorb the wellbore fluid and swell. In an exemplary embodiment wherein one or more of the packers 202*a-c* are deployed in the horizontal portion 206, the packers 202*a-c* can begin swelling once the depth of the horizontal portion 206 is reached, i.e., prior to reaching the desired location. However, the final insertion of the distal portion 203 through the horizontal portion 206 can take a relatively short amount of time, due to the relative simplicity of the proximal portion 208 in comparison to the distal portion 203; therefore, the packers 202*a-c* can be fully inserted to the desired horizontal position 206 before they swell sufficiently to engage the side of the wellbore 15. Once reaching the desired location, the insertion of the wellbore completion 200 can halt, and the interior layer 12 of each of the packers 202*a-c* can swell until each can sealingly engage the side of the wellbore 15. Having swelled, the packers 202*a-c* can effectively seal portions of a wellbore 15 from one another, as desired.

Figure 4:
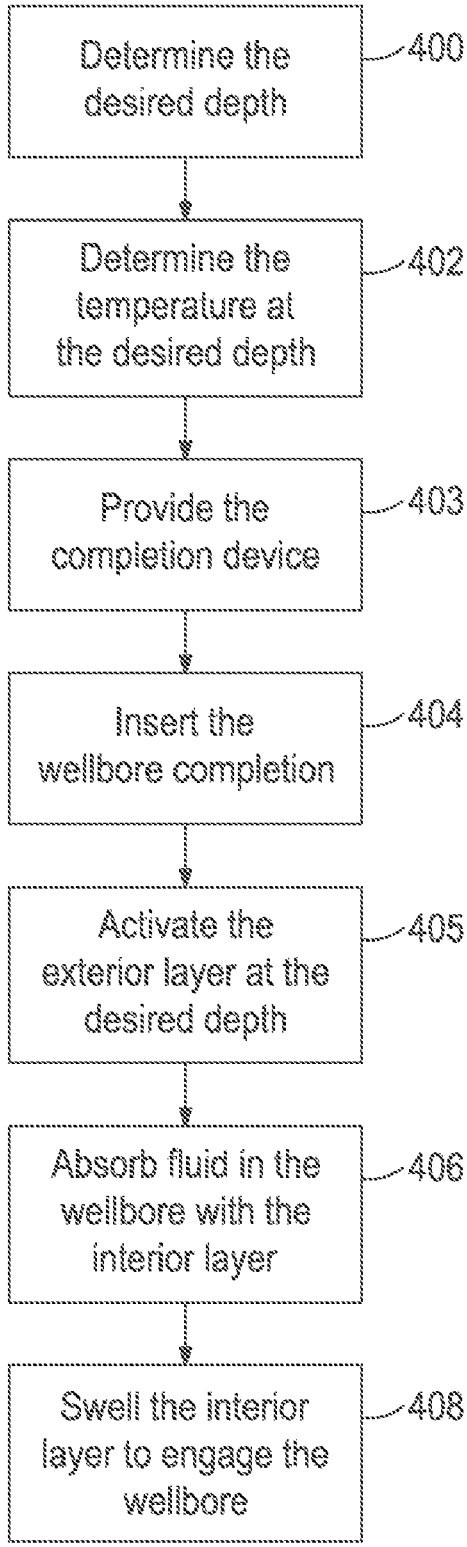
FIG. 4 depicts a flow chart of an exemplary method of deploying a wellbore completion, in accordance one or more embodiments described.

FIG. 4, with continued reference to FIGS. 1-3, illustrates a flow chart of an exemplary method for deploying the completion device 10 into the wellbore 15. The method can include determining the desired or activation depth, as shown at 400. The activation depth can be related to a temperature using a known temperature gradient in the wellbore, or by conducting a geothermal survey, shown at 402. The method can include providing the completion device 10, as at 403, including the interior and exterior layers 12, 14, as described above. The exterior layer 14 can include a material configured to activate at or within about 5° F. of the temperature of the wellbore fluid at the activation depth. For example, the exterior layer 14 can include an alloy configured to soften and/or melt at or within about 5° F. of the temperature of the fluid in the wellbore at the activation depth. Alternatively or additionally, the exterior layer 14 can include a shape memory alloy configured to deform at or within about 5° F. of the temperature of the wellbore fluid at the activation depth.

The completion device 10 can be inserted into the wellbore 15, for example, on a tube string 11 as part of a wellbore completion 200, shown at 404. Once reaching the activation depth, the exterior layer 14 can be activated by the local temperature in the wellbore at the depth, shown at 405. Activation can include softening and/or melting and shearing away at least a portion of the exterior layer 14, and/or deforming the exterior layer 14, such as by shrinking, warping, folding, or rupturing the exterior layer 14, at the activation depth. The activation of the exterior layer 14 can expose at least a portion of the interior layer 12, thereby allowing the interior layer 12 to absorb some of the fluid in the wellbore 15, shown at 406, causing the interior layer 12 and, accordingly, the completion device 10 to expand. The completion device 10 can expand as the interior layer 12 swells, until the completion device 10 engages the wellbore 15, shown at 408.

Although exemplary embodiments of the completion device 10 have been described above with reference to a packer, other downhole tools and oil field elements can be equally effective. Such tools and elements can include bridge plugs, seal bore assemblies and expansion/contraction joints.

Certain embodiments and features have been described using a set of numerical upper limits and a set of numerical lower limits It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A completion device for a wellbore, comprising:

an interior layer that swells when exposed to a wellbore fluid; and an exterior layer encasing the interior layer and configured of shape-memory alloy to be impermeable to the wellbore fluid at temperatures below an activation depth temperature, and configured to be permeable to the wellbore fluid at temperatures above the activation depth temperature to expose the interior layer.

2. The completion device of claim 1, wherein the interior layer comprises an elastomeric material.

3. The completion device of claim 1, wherein the exterior layer is resistive to chemical degradation by water or hydrocarbon.

4. The completion device of claim 3, wherein the exterior layer is resistive to chemical degradation by aqueous hydrogen sulfide, brine, or dissolved carbon dioxide.

5. The completion device of claim 1, wherein the exterior layer comprises an alloy having a melting temperature of within about 5° F. of the activation depth temperature, wherein the exterior layer melts at an activation depth to expose the interior layer to the wellbore fluid.

6. The completion device of claim 1, wherein the shape-memory alloy comprises a Cu—Al—Ni alloy, an Fe—Mn—Si—Cr—Ni alloy, a Cu50Zr50 alloy, or a NiTi alloy.

7. The completion device of claim 1, wherein the interior and exterior layers are annular and concentric.

8. The completion device of claim 7, wherein:

the interior layer is disposed around a downhole tool and is swellable between a pre-activation diameter that is less than an inside diameter of the wellbore and a post-activation diameter that is greater than the pre-activation diameter; and the completion device is configured to sealingly engage a side of the wellbore when the interior layer swells to the post-activation diameter.

9. The completion device of claim 1, wherein the interior layer or the exterior layer comprises one or more arc-shaped segments.

10. A method of deploying a completion device into a wellbore, comprising:

encasing an interior layer of the completion device in a temperature-sensitive exterior layer of shape-memory alloy that is impermeable to a fluid in the wellbore at temperatures below an activation depth temperature;

attaching the completion device on a tube string;

inserting the tube string into the wellbore;

creating a leak path in the temperature-sensitive exterior layer to expose the interior layer in response to the completion device being exposed to the activation depth temperature in the wellbore; and swelling the interior layer with the fluid in the wellbore.

11. The method of claim 10, wherein the interior layer comprises an elastomeric material.

12. The method of claim 10, wherein the temperature sensitive exterior layer comprises an alloy having a melting temperature that is within about 5° F. of the temperature at the desired depth.

13. The method of claim 12, wherein creating the leak path in the temperature-sensitive exterior layer comprises melting at least a portion of the temperature-sensitive exterior layer.

14. The method of claim 10, wherein the temperature-sensitive exterior layer is resistive to chemical degradation by water, brine, or hydrocarbon.

15. The method of claim 14, wherein the temperature-sensitive exterior layer is resistive to chemical degradation by the presence of aqueous hydrogen sulfide or carbon dioxide in the fluid in the wellbore.

16. The method of claim 10, wherein:

creating the leak path in the temperature sensitive exterior layer comprises shrinking, warping, folding, or rupturing at least a portion of the temperature-sensitive exterior layer at the desired depth.

17. A method of deploying a packer in a wellbore, comprising:

encasing a swellable interior layer within an impermeable exterior layer of shape-memory alloy;

disposing the packer on a tube string;

inserting the tube string into the wellbore;

activating the exterior layer with a local temperature of a fluid in the wellbore at a desired depth, the local temperature within about 5° F. of an activation temperature of the alloy, the activating to create a leak path through the exterior layer such that the interior layer is exposed to the fluid in the wellbore; and swelling the interior layer until the packer sealingly engages the wellbore.

18. The method of claim 17, wherein:

The activation temperature is a melting temperature of the alloy; and activating the exterior layer with the local temperature comprises melting the alloy and shearing the alloy from the interior layer to create the leak path.

19. The method of claim 17, wherein:

activating the exterior layer with the local temperature comprises deforming the exterior layer at the desired depth to create the leak path.

* * * * *